US008104196B2

(12) United States Patent
Spinelli

(10) Patent No.: US 8,104,196 B2
(45) Date of Patent: Jan. 31, 2012

(54) SHOE WITH DETACHABLE SOLE AND VAMP

(76) Inventor: David Paolo Spinelli, Torrita di Siena (IT)

( * ) Notice: Subject to any disclaimer, the term of this patent is extended or adjusted under 35 U.S.C. 154(b) by 520 days.

(21) Appl. No.: 12/307,008

(22) PCT Filed: Oct. 16, 2006

(86) PCT No.: PCT/IT2006/000745

§ 371 (c)(1),
(2), (4) Date: Dec. 30, 2008

(87) PCT Pub. No.: WO2008/007403

PCT Pub. Date: Jan. 17, 2008

(65) Prior Publication Data

US 2009/0313851 A1 Dec. 24, 2009

(30) Foreign Application Priority Data

Jul. 12, 2006 (IT) ..... FI20060043 U

(51) Int. Cl.
*A43B 3/24* (2006.01)
*A43B 9/00* (2006.01)

(52) U.S. Cl. ..... 36/100; 36/15; 36/101

(58) Field of Classification Search ..... 36/15, 100, 36/101

See application file for complete search history.

(56) References Cited

U.S. PATENT DOCUMENTS

| | | | | |
|---|---|---|---|---|
| 2,178,025 | A * | 10/1939 | Eduard | 36/101 |
| 2,438,711 | A | 3/1948 | Leach et al. | |
| 2,510,236 | A * | 6/1950 | Kutcher | 36/11.5 |
| 3,012,341 | A * | 12/1961 | Waldemar | 36/100 |
| 3,812,601 | A * | 5/1974 | Flottorp | 36/101 |
| 4,366,633 | A * | 1/1983 | Flottorp | 36/101 |
| 4,974,344 | A * | 12/1990 | Ching | 36/101 |
| 5,317,822 | A * | 6/1994 | Johnson | 36/101 |
| 7,272,897 | B2 * | 9/2007 | Yu | 36/11.5 |
| 7,347,010 | B2 * | 3/2008 | Yu | 36/11.5 |
| 2010/0088927 | A1 * | 4/2010 | Spinelli | 36/101 |

FOREIGN PATENT DOCUMENTS

| | | |
|---|---|---|
| DE | 456 185 | 2/1928 |
| EP | 1 749 454 | 2/2007 |
| FR | 775 508 | 12/1934 |
| GB | 402 975 | 12/1933 |
| IT | AR 950 006 | 8/1996 |

* cited by examiner

*Primary Examiner* — Marie Patterson
(74) *Attorney, Agent, or Firm* — McGlew amd Tuttle, P.C.

(57) ABSTRACT

Shoe with detachable sole and vamp, in which: the sole (1) has an upper surface (2) on which several tubular elements (4) are applied spaced from each other by a preset value; the vamp (7) has a lower surface (6) on which there are applied several tubular elements (8) spaced from each other by a preset value; the vamp (7) can be positioned onto the sole (1) by positioning said lower surface (6) of the vamp (7) onto the upper surface (2) of the sole (1) with the insertion of the tubular elements (8) of the vamp (7) between the tubular elements (4) of the sole (1); and the vamp (7) is detachably anchored to the sole (1) by inserting a wire (9) through the said tubular elements of the sole and the vamp after positioning of the vamp onto the sole. Said tubular elements of the sole (1) are placed according an open annular path, with two tubular elements (40, 41) disposed in correspondence of a respective end of the open annular path and communicating with the outside of the sole (1).

6 Claims, 7 Drawing Sheets

FIG.1
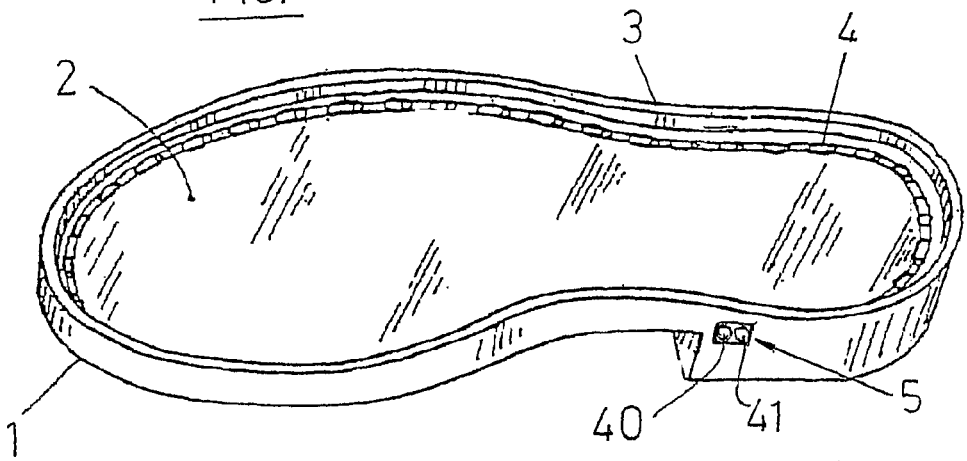
FIG.2
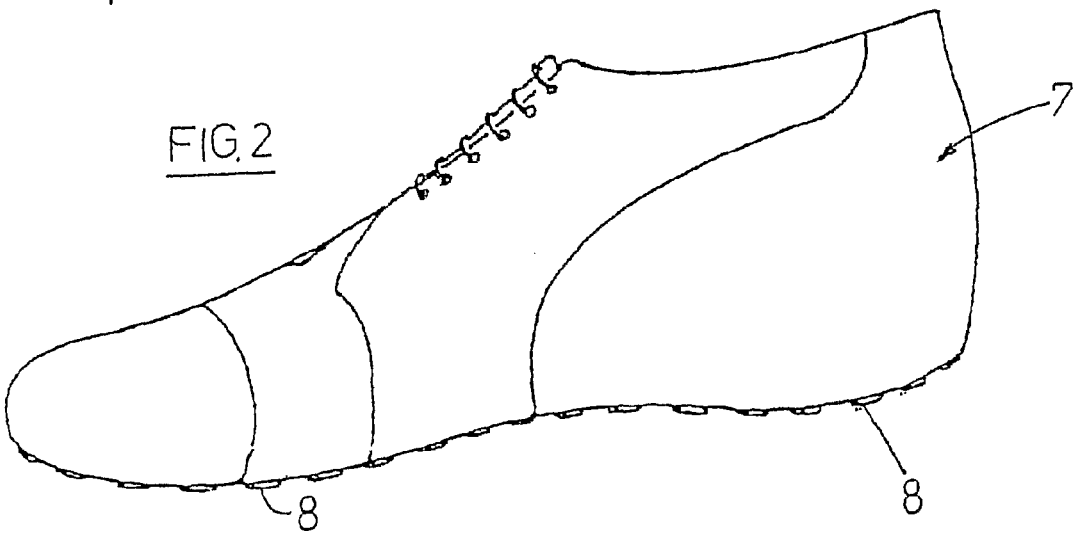
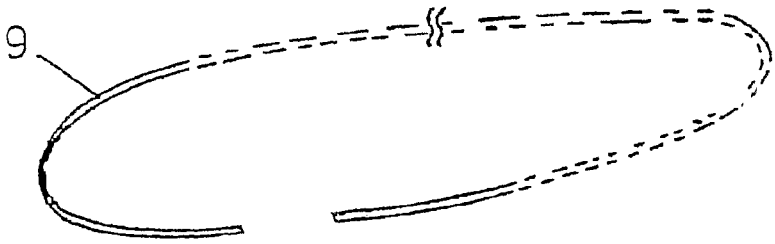
FIG.3

SHOE WITH DETACHABLE SOLE AND VAMP

The present invention relates to a shoe with detachable sole and vamp.

In particular, a shoe according to the present invention has the sole and the vamp joined to each other in a reversible manner, by means of a coupling device which allows their firm joining, during assemblage and use, and reciprocal separation when required.

The main aim of the present invention is to provide a shoe with detachable sole and vamp, which is particularly simple to manufacture and to use, without prejudice for the firm coupling between the sole and the vamp.

This result has been achieved according to the invention thanks to a shoe having the features described in claim 1. Further features of the present invention are the object of the dependant claims.

Thanks to the present invention, it is possible to manufacture a shoe as described above, in which the assembling and disassembling operations, i.e. joining the sole to the vamp and respectively separation of the sole from the vamp, are extremely simplified, thus exalting the advantages of this type of footwear, both in terms of manufacture and use of the shoe. Moreover, it is possible to provide a very strong joining between the sole and the vamp in all conditions of use. At the same time, the manufacturing of the shoe is simplified, thus reducing the total costs.

These and further advantages and characteristics of the invention will be best understood by anyone skilled in the art from a reading of the following description in conjunction with the attached drawings given as a practical exemplification of the invention, but not to be considered in a limitative sense, wherein:

FIG. 1 is a perspective top view of a sole for footwear according to the invention;

FIG. 2 is a schematic side view of a vamp for footwear according to the invention;

FIG. 3 shows the wire which joins the sole and the vamp of FIGS. 1 and 2;

Figure 13:
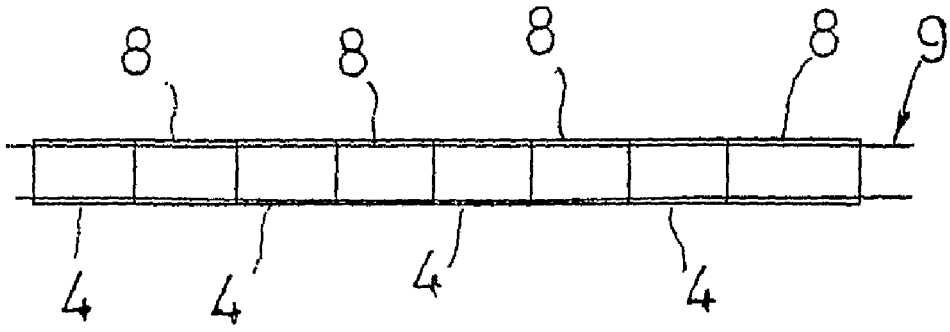
Figure 14:
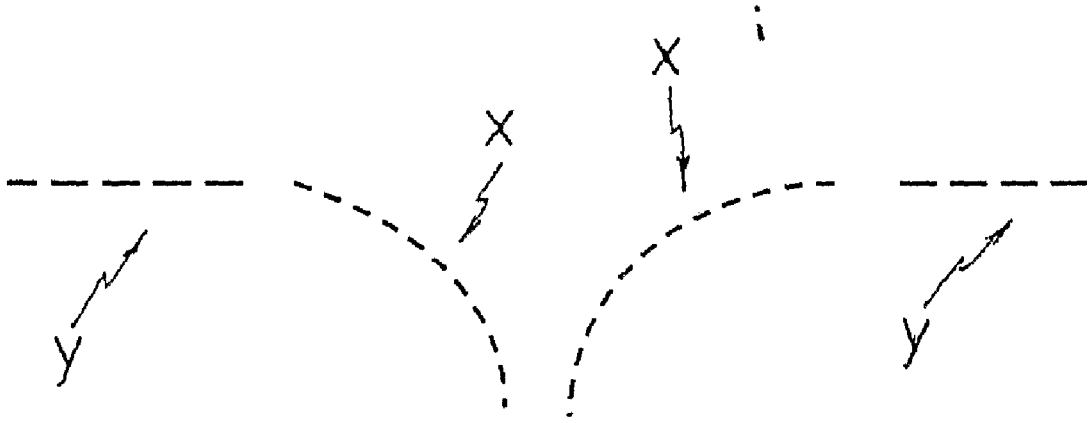

FIG. 13 schematically shows the tubular structure formed by the tubular elements of the sole and the vamp, with the joining wire (9) passing through the tubular structure;

FIG. 14 is a scheme showing the direction of the longitudinal axis of some of the tubular elements of the sole.

Reference being made to the enclosed drawings, a shoe according to the present invention has a sole (1), featuring an upper surface (2) whose outline is delimited by a raised edge (3). Said surface (2) has a hollow (10) in which there are placed more tubular elements or portions (4, 40, 41) disposed according to a circuit which, substantially, reproduces the outline of the sole within the area delimited by said edge (3). Said tubular portions are spaced of a preset value, so that between two adjacent-tubular portions there is a free space.

In other words, said tubular portions are placed according to a substantially open annular path, at the inner and close to the edge (3) of the sole (1), in correspondence of a hollow (10) of the upper surface (2) of the latter; and they form a kind of toothing disposed according to an open annular profile, with two ends (40, 41) of the so formed open ring communicating with the outside of the sole.

In practice, according to the embodiment shown in the drawings, two tubular portions (40, 41), disposed at the ends of said open annular path, have a side internal to the said hollow (10) and a side internal to a window (5) which is formed on an external side of the sole (1) and which communicates with the same hollow (10).

In such a way, it is realized an open annular sequence of tubular elements disposed on the inner of the sole but communicating with the outside.

As shown in the enclosed drawings, the elements (40) and (41) disposed at the ends of the sequence have a curvilinear axis (x), contrary to the intermediate elements (4) which have a rectilinear axis (y).

Advantageously, said window (5) is formed on the inner side of the sole (1), approximately in the heel zone, so as to result less visible.

The lower surface (6) of the vamp (7) has, in correspondence of its border or external edge, a corresponding sequence of tubular elements (8) which are placed according to an annular disposition and are spaced by a preset value, in order to form a kind of annular toothing with tubular teeth. The sequence of the tubular elements (8) is closed, that is, differently from those of the sole, the tubular elements (8) are disposed in such a way to define, in the whole, a closed annular path.

The annular profile defined by the tubular elements (8) of the vamp (7) corresponds to the annular profile defined by the tubular elements (4) of the sole (1).

In order to join the sole (1) to the vamp (7), it is used a wire (9)—for example a wire made of plastic material like PVC—which is made to pass through the tubular elements (4,40, 41, 8) of the sole (1) and the vamp (7), respectively.

Figure 4:
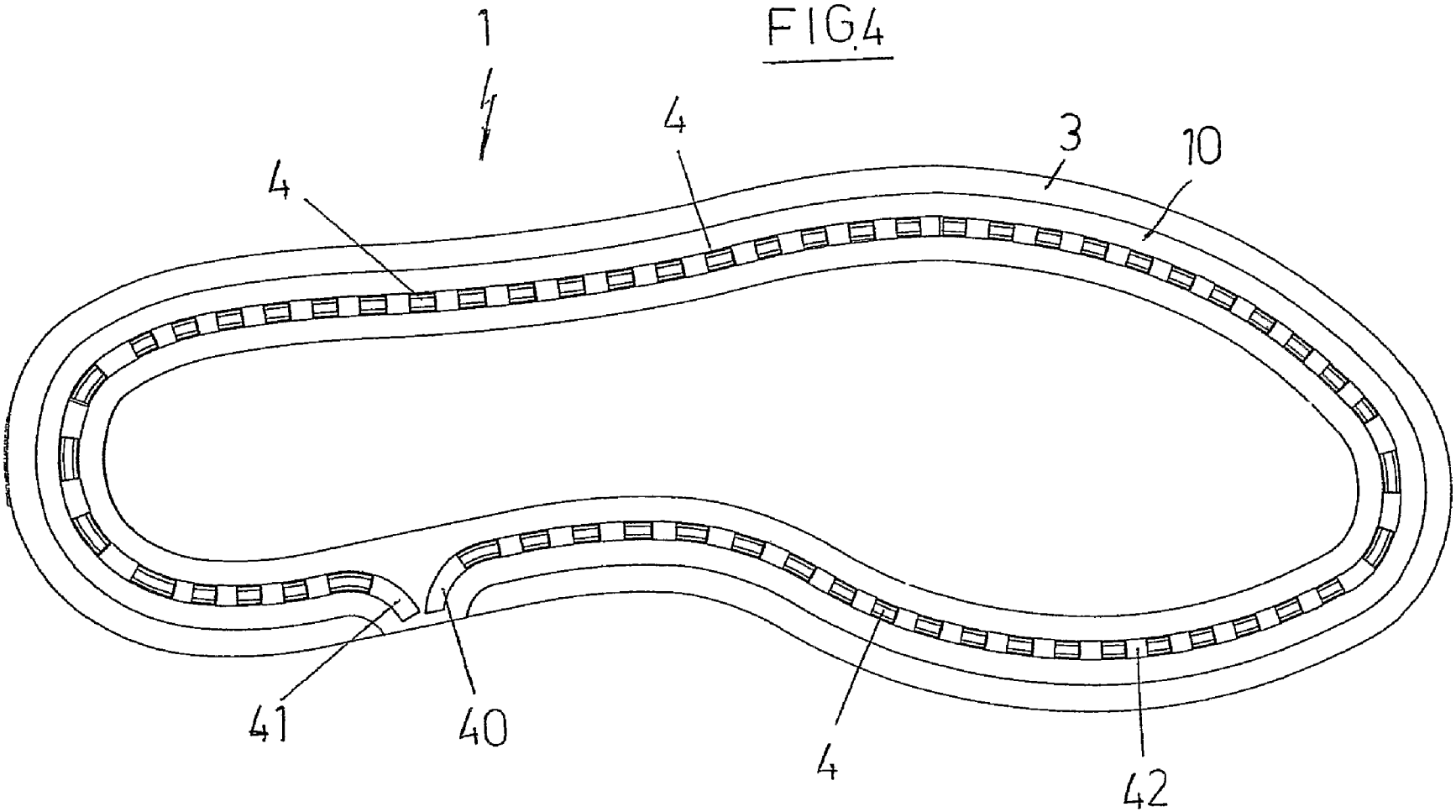
FIG. 4 is a plan view showing a sole for footwear according to the present invention.
Figure 5:
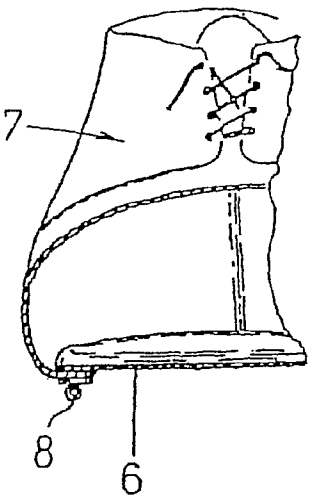
FIG. 5 is a cross section view of the vamp.
Figure 6:
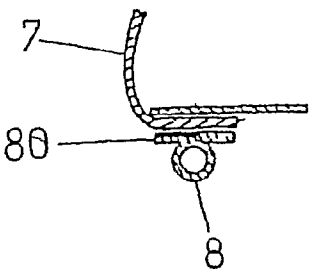
FIG. 6 shows an enlarged detail of FIG. 6.
Figure 7:
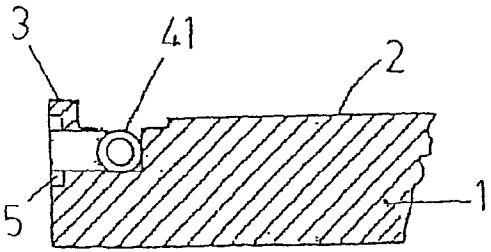
FIG. 7 is a schematic cross section view of the sole at an end of the annular open circuit defined by the relevant tubular elements.
Figure 8:
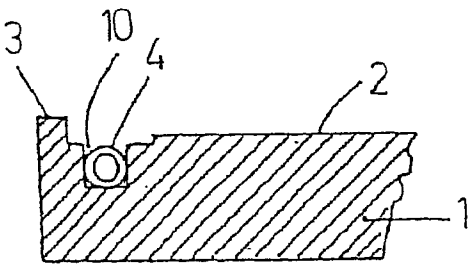
FIG. 8 is a schematic cross section view of the sole at an intermediate point of the annular open circuit defined by the relevant tubular elements.
Figure 9:
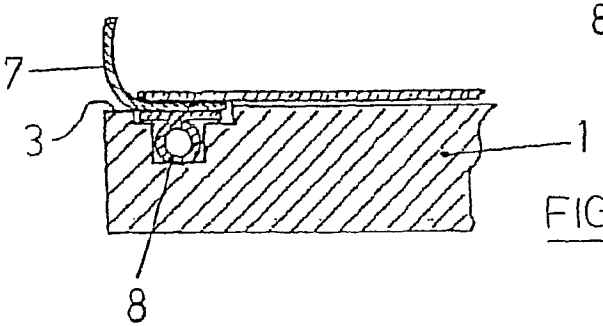
FIG. 9 is a schematic partial cross section view which shows the coupling between sole and vamp at an intermediate point of the aforesaid annular circuit.
Figure 10:
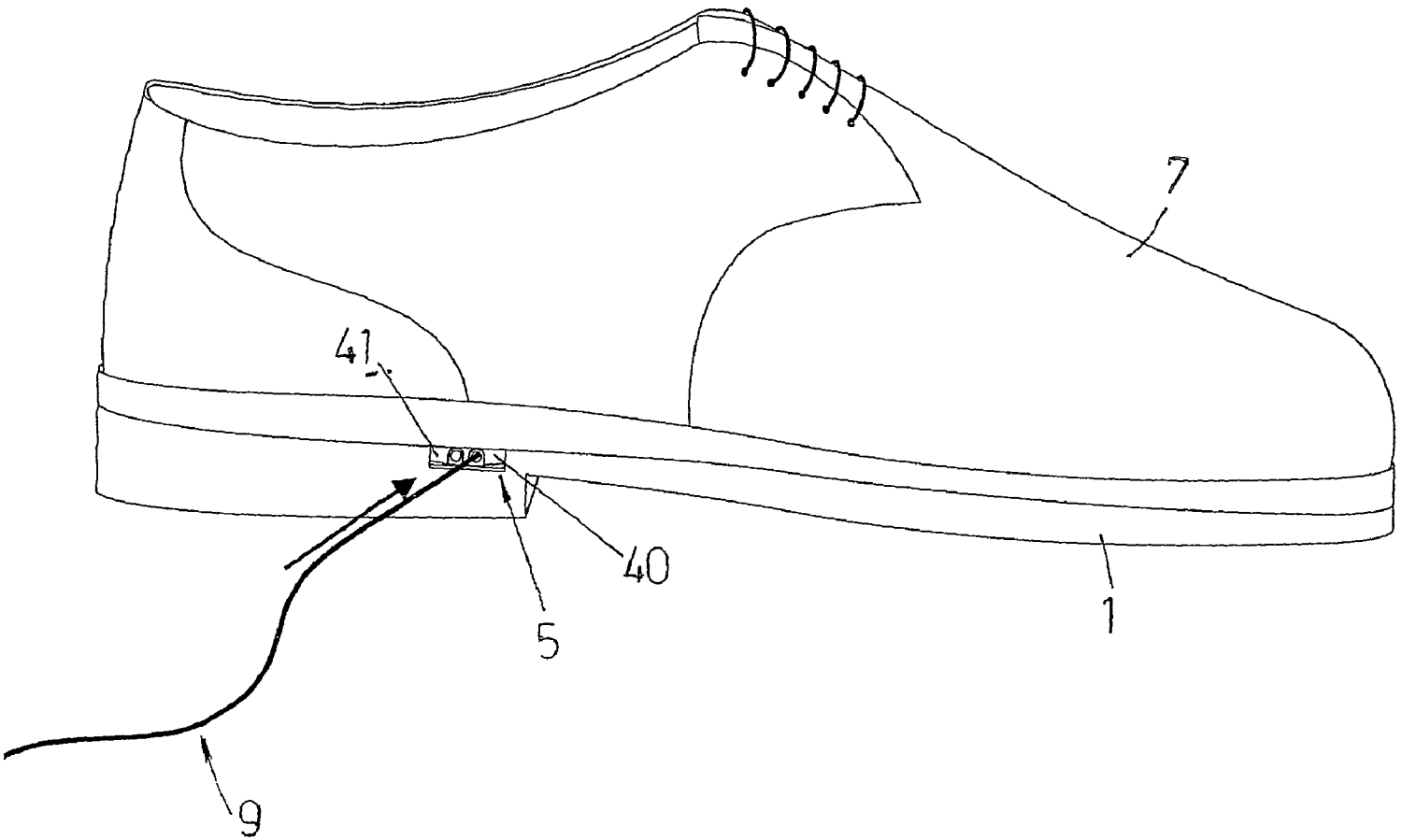
FIGS. 10 and 11 show two phases relevant to the insertion of the wire of FIG. 3 for joining the sole and the vamp together.
Figure 11:
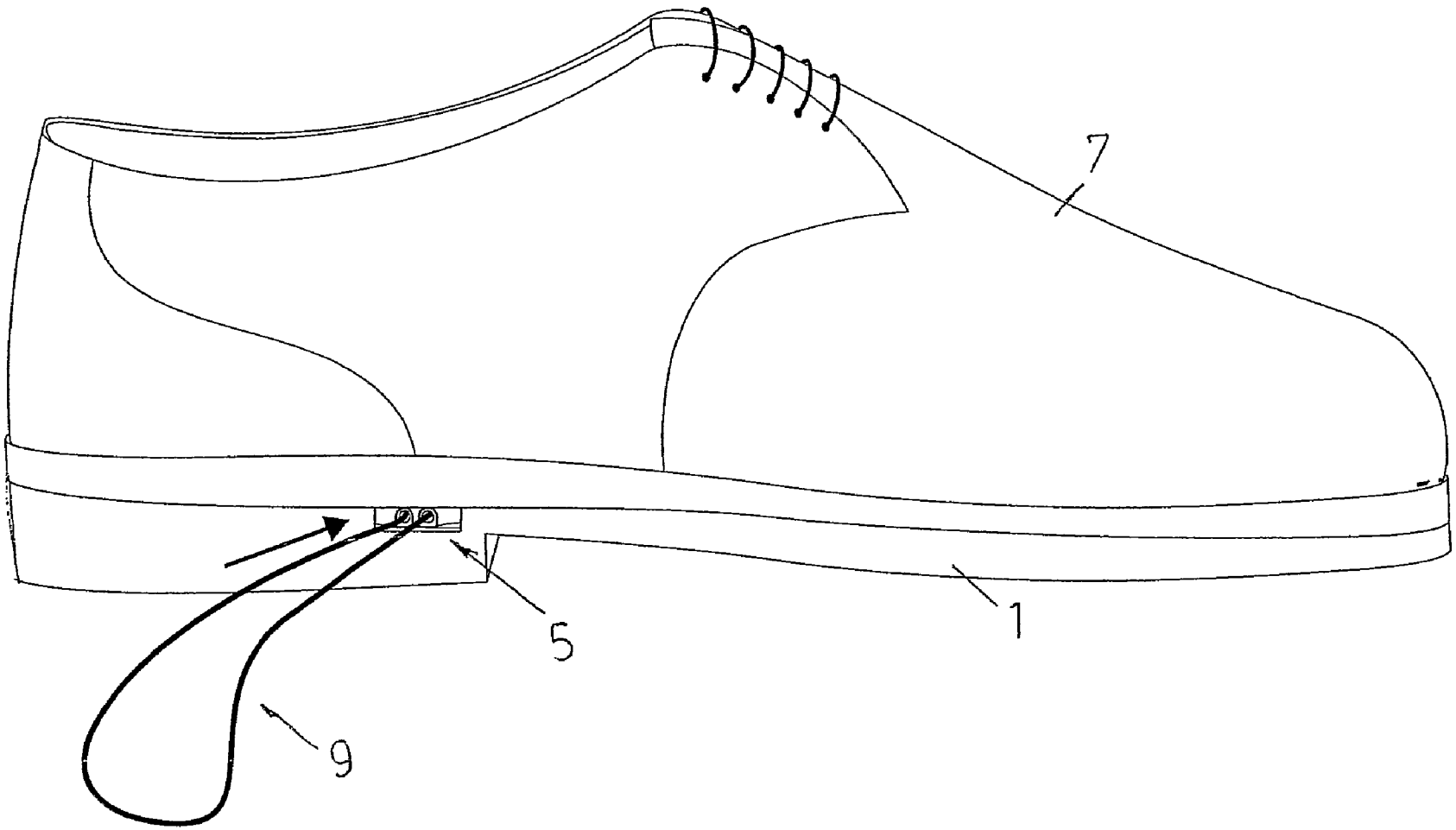
Figure 12:
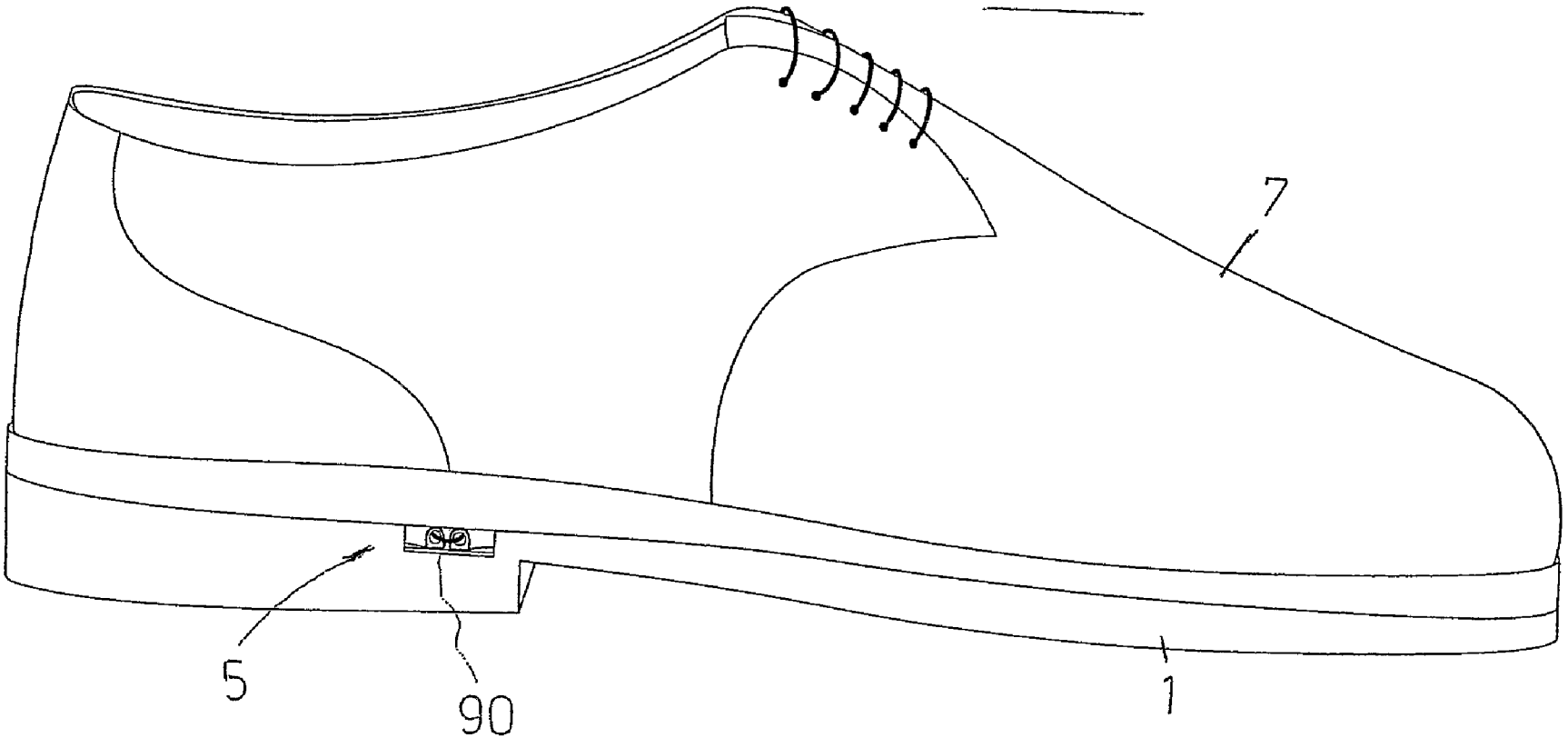
FIG. 12 shows the shoe when the joining between the sole and the vamp is completed.

More particularly, the vamp (7) is placed on the sole (1), so that each tubular element (8) is disposed in the hollow (10) on the upper side of the sole (1) between two tubular elements (4) of the latter. In this way, it is formed a substantially continuous tubular structure which has the shape of an open annular figure (because the elements 40 and 41 communicate with the outside of the sole), which is internal to said hollow (10) and which is not visible being hidden by the raised edge (3) of the sole (1). Then, through the said window (5) placed at the side of the sole (1), a first end of the wire (9) is passed through the tubular element (40) and the other end is passed through the tubular element (41), as shown in FIGS. 10 and 11, pushing the wire, which is forced to flow in the tubular elements (4) and (8) of the sole (1) and the vamp (7). When the wire is totally pushed, since the length of the wire (9) is the same of the length of the substantially continuous tubular structure defined by said elements (4) and (8), only a part (90) of the wire remains in the window (5) of the sole (1), as shown in FIG. 12. The anchoring realized by the wire (9) between the elements (4) and the elements (8) is very strong, although it is removable and, consequently, the joining between the sole (1) and the vamp (7) is correspondingly strong. When desired, it is possible to detach the sole (1) from the vamp (7) pulling the portion (90) of the wire (9), for example by making use of any tool provided with a tip apt to be inserted between said portion (90) of the wire and said window (5); when the wire (9) is completely extracted, the sole is detached from the vamp.

The tubular elements (4, 40, 41) of the sole (1) are attached to each other by a base track (42) which, when the sole (1) is formed, is glued to the bottom of said hollow (10).

Analogously, the tubular elements (8) of the vamp (7) are attached to each other by a base track (80) which, when the vamp (7) is formed, is sewn on the border of said surface (6).

The tubular elements (4, 40, 41) of the sole (1), the tubular elements (8) of the vamp (7) and the respective anchoring tracks (42, 80) can be realized in plastic materials with moulding procedures of known type.

It is however evident that the tubular elements (4, 40, 41, 8) can be applied to the sole and the vamp in any suitable way.

In practice, the execution details may vary as regards the shape, the size, the arrangement of the elements, the kind of material used, but they are within the limits of the solution adopted and within the limits of the protection offered by the present patent.

The invention claimed is:

1. A shoe, comprising:

a detachable sole and vamp, the sole having an upper surface on which sole tubular elements are applied spaced from each other by a preset value, said vamp having a lower surface on which vamp tubular elements are applied, said vamp tubular elements being spaced from each other by a preset value, said vamp being positioned onto the sole by positioning said lower surface of the vamp onto the upper surface of the sole with the insertion of the vamp tubular elements between the sole tubular elements, said vamp being detachably anchored to the sole by inserting a wire through said sole tubular elements and said vamp tubular elements after positioning of the vamp onto the sole, said sole tubular elements being placed according an open annular path, with two end tubular elements disposed in correspondence of a respective end of the open annular path and communicating with the outside of the sole, each of said end tubular elements having one side inside said upper surface and another side on the outside of the sole, said another side being internal to a window, wherein an interior of the sole is in communication with the outside via said window.

2. Shoe according to claim 1, wherein said sole tubular elements are in a hollow of the upper surface of the sole, said hollow being inside and close to a raised edge of the sole and having an annular open profile.

3. Shoe according to claim 1, wherein each of said end tubular elements has a side inside said upper surface and a side on the outside of the sole.

4. Shoe according to claim 1, wherein each of said end tubular elements has a curvilinear longitudinal axis.

5. A shoe, comprising:

a sole comprising an opening;

a first plurality of tubular elements, said first plurality of tubular elements comprising a first tubular end element and a second tubular end element;

a vamp;

a second plurality of tubular elements;

a wire, said sole having an upper surface, said first plurality of tubular element being applied to said upper surface, each of said first plurality of tubular elements being located at a spaced location from another one of said first plurality of tubular elements, said vamp having a lower surface, said second plurality of tubular elements being applied to said lower surface, each of said second plurality of tubular elements being located at a spaced location from another one of said second plurality of tubular elements, said vamp being positioned onto the sole by positioning said lower surface of the vamp onto the upper surface of the sole, wherein said second plurality of tubular elements are inserted between said first plurality of tubular elements, said wire being inserted through said first plurality of tubular elements and said second plurality of tubular elements, wherein said vamp is detachably connected to said sole via said wire, said first plurality of tubular elements and said second plurality of tubular elements, said first plurality of tubular elements being arranged in an open annular path, said first tubular end element being arranged at one end portion of said open annular path, said second tubular end element being arranged at another end portion of said open annular path, each of said first tubular end element and said second tubular end element having one end arranged at or adjacent to said opening.

6. A shoe in accordance with claim 5, wherein each of said first end tubular element and said second end tubular element has another end arranged inside a hollow portion defined by said upper surface, said first tubular end element and said second tubular end element being in communication with an environment outside of said sole via said opening, wherein an interior of said sole is in communication with the environment outside of said sole via at least said opening.

* * * * *

UNITED STATES PATENT AND TRADEMARK OFFICE

CERTIFICATE OF CORRECTION

PATENT NO. : 8,104,196 B2
APPLICATION NO. : 12/307008
DATED : January 31, 2012
INVENTOR(S) : Spinelli It is certified that error appears in the above-identified patent and that said Letters Patent is hereby corrected as shown below:

Title page, item [30] - Foreign Application Priority Data should read as follows: FI2006U000043.

Signed and Sealed this
Tenth Day of April, 2012

David J. Kappos

David J. Kappos
*Director of the United States Patent and Trademark Office*